US009709367B2

(12) United States Patent
Neugebauer

(10) Patent No.: US 9,709,367 B2
(45) Date of Patent: Jul. 18, 2017

(54) CARTRIDGE CASING AND METHOD OF MANUFACTURING A CARTRIDGE CASING

(71) Applicant: Hans-Jurgen Neugebauer, Warburg (DE)

(72) Inventor: Hans-Jurgen Neugebauer, Warburg (DE)

( * ) Notice: Subject to any disclaimer, the term of this patent is extended or adjusted under 35 U.S.C. 154(b) by 0 days.

(21) Appl. No.: 15/439,279

(22) Filed: Feb. 22, 2017

(65) Prior Publication Data

US 2017/0160061 A1 Jun. 8, 2017

Related U.S. Application Data

(63) Continuation of application No. 14/130,764, filed as application No. PCT/EP2012/063333 on Jul. 6, 2012, now Pat. No. 9,625,241.

(30) Foreign Application Priority Data

Jul. 6, 2011 (EP) ..... 11172933

(51) Int. Cl.
*F42B 5/26* (2006.01)
*F42B 5/285* (2006.01)
*F42B 5/307* (2006.01)

(52) U.S. Cl.
CPC ..... *F42B 5/26* (2013.01); *F42B 5/285* (2013.01); *F42B 5/307* (2013.01)

(58) Field of Classification Search
CPC .. F42B 5/285; F42B 5/307; F42B 5/26; F42B 5/28; F42B 5/30

(Continued)

(56) References Cited

U.S. PATENT DOCUMENTS 2,294,822 A * 9/1942 Albree ..... F42B 5/285 102/464
2,818,021 A * 12/1957 Boehm ..... F42B 5/285 102/469

(Continued)

FOREIGN PATENT DOCUMENTS

DE 2225464 A1 12/1972
FR 655854 A 4/1929

(Continued)

OTHER PUBLICATIONS

International Search Report and Written Opinion mailed Sep. 25, 2012 in corresponding PCT application No. PCT/EP2012/063333.

(Continued)

*Primary Examiner* — Joshua Freeman
(74) *Attorney, Agent, or Firm* — Nields, Lemack & Frame, LLC

(57) ABSTRACT

The present invention relates to a cartridge casing for firearm ammunition and to a method of manufacturing such casing. The casing (1) comprises an elongate interior cavity (4) and extends along a longitudinal axis (5). The cavity (4) is open at the top end of the casing (1) and is defined radially by a circumferentially extending sidewall (3) formed by an elongate tubular portion and at the bottom by a bottom wall (2) which is connected to an axial end of the tubular portion and comprises a bore (7). The casing (1) further comprises in a lateral outer surface an annular projection (18) located proximate the bottom end of the casing (1) and extending circumferentially in a plane perpendicular to the longitudinal axis (5) of the casing (1). The casing (1) comprises an elongate tubular sleeve component (10) open at both axial ends and a separate bottom component (11) fixedly secured to the sleeve component (10). The tubular portion is formed by the sleeve component (10), and the bottom wall (2) is formed at least in part by the bottom component (11). The (Continued)

bottom component (11) comprises a lower axial end surface (8), an opposite upper axial end surface (15) and a circumferentially extending lateral outer surface on which the annular projection (18) is arranged. The casing (1) may be manufactured by providing the bottom component (11) and the sleeve component (10) and fixedly securing the sleeve component (10) to the bottom component (11).

15 Claims, 4 Drawing Sheets

(58) Field of Classification Search
USPC ..... 102/464, 470, 428
See application file for complete search history.

(56) References Cited

U.S. PATENT DOCUMENTS

| | | | | | |
|---|---|---|---|---|---|
| 2,823,611 | A * | 2/1958 | Thayer | F42B 5/285 | 102/469 |
| 2,902,934 | A * | 9/1959 | Louis | B21D 51/54 | 102/464 |
| 3,034,433 | A * | 5/1962 | Gronn | F42B 5/295 | 102/464 |
| 3,099,958 | A * | 8/1963 | Daubenspeck | F42B 7/06 | 102/449 |
| 3,408,718 | A | 11/1968 | Weaver | | |
| 3,435,765 | A | 4/1969 | Gawlick | | |
| 3,874,294 | A * | 4/1975 | Hale | F42B 5/307 | 102/467 |
| 3,955,506 | A * | 5/1976 | Luther | F42B 5/307 | 102/467 |
| 4,147,107 | A * | 4/1979 | Ringdal | F42B 5/307 | 102/467 |
| 4,481,885 | A * | 11/1984 | Erickson | F42B 5/30 | 102/466 |
| 4,509,428 | A * | 4/1985 | Davich | F42B 5/30 | 102/448 |
| 9,625,241 | B2 | 4/2017 | Neugebauer | | |
| 2005/0115446 | A1* | 6/2005 | Heitmann | F42B 5/18 | 102/469 |
| 2006/0159989 | A1 | 7/2006 | Bouffard | | |
| 2006/0207464 | A1* | 9/2006 | Maljkovic | C08L 65/02 | 102/466 |
| 2012/0024183 | A1* | 2/2012 | Klein | F42B 5/307 | 102/467 |
| 2012/0111219 | A1* | 5/2012 | Burrow | F42B 5/307 | 102/467 |
| 2013/0014664 | A1* | 1/2013 | Padgett | F42B 5/313 | 102/439 |
| 2013/0186294 | A1* | 7/2013 | Davies | F42B 5/307 | 102/467 |
| 2014/0224144 | A1 | 8/2014 | Neugebauer | | |

FOREIGN PATENT DOCUMENTS

| | | | |
|---|---|---|---|
| FR | 1375106 | A | 10/1964 |
| GB | 469370 | A | 7/1937 |
| GB | 574877 | A | 1/1946 |
| JP | 31-9800 | B | 1/1956 |
| JP | 2008-531977 | A | 8/2008 |
| JP | 2014-527609 | A | 10/2014 |
| WO | 2006/094987 | A1 | 9/2006 |
| WO | 2007/014024 | A2 | 2/2007 |

OTHER PUBLICATIONS

International Preliminary Report on Patentability mailed Jan. 16, 2014 in corresponding PCT application No. PCT/EP2012/063333.
European communication mailed Dec. 14, 2011 in corresponding European patent application No. 11172933.1.
Japanese communication, with English translation, dated Apr. 5, 2016 in corresponding Japanese patent application No. 2014-517837.
Japanese communication, with English translation, dated Dec. 13, 2016 in corresponding Japanese patent application No. 2014-517837.

* cited by examiner

CARTRIDGE CASING AND METHOD OF MANUFACTURING A CARTRIDGE CASING

This application is a continuation of U.S. patent application Ser. No. 14/130,764 filed Feb. 25, 2014, the disclosure of which is incorporated herein by reference in its entirety. U.S. patent application Ser. No. 14/130,764 is a 371 of International Application No. PCT/EP2012/063333 filed Jul. 6, 2012, which claims priority of European Patent Application No. 11172933.1 filed Jul. 6, 2011.

The present invention relates to a cartridge casing for firearm ammunition, which casing comprises an elongate interior cavity for receiving and retaining a propellant and a projectile.

Firearm ammunition cartridges typically comprise a casing holding the projectile or bullet, a propellant, such as gunpowder or cordite, and an igniting means including a primer or igniting medium. Thus, the casing is used as a container for functionally holding together and arranging the other cartridge components.

The casing is usually cup-shaped and generally of circular or cylindrical symmetry. For example, the casing may be cylindrical or may comprise two or more cylindrical sections having different diameters, e.g. to form a necked configuration. Within the casing, the propellant is disposed between a bottom wall of the casing and the projectile disposed and maintained e.g. by friction in an upper opening of the casing, and the igniting means is located at or within the bottom wall. In use, the cartridge is loaded into the firing chamber of a firearm at the rearward end of the firearm barrel such that the projectile is oriented in the direction of the barrel and the bottom wall or rearward end including the igniting means faces a cooperating igniting device of the firearm, such as a firing pin or striker. The dimensions of a casing of a cartridge suitable for use with a particular firearm are specifically chosen to match the firearm barrel such that the casing diameter is slightly less than the barrel diameter.

Upon operating the firearm the igniting device of the firearm acts upon the igniting means of the cartridge such that the primer or igniting medium is ignited or produces a spark and in turn ignites the propellant. Usually a firing pin or striker ignites the primer or igniting medium by means of a mechanical impact. Once the propellant has been ignited and burns, production of gases within the casing results in an increase in pressure in the casing interior. Due to this pressure the casing expands to form a gas-tight seal against the wall of the firing chamber, and then the projectile is detached from the casing and accelerated down the barrel. With the projectile moving along and out of the barrel the pressure decreases again, and subsequently the empty casing is removed from the firing chamber.

In the above process the gas-tight seal formed between the casing and the walls of the firing chamber also serves the purpose of preventing that the gases generated inside the casing escape the firearm via a path different from the barrel, which escape would yield a high risk of serious injuries being caused to the user of the firearm.

The pressure that builds up within the casing following ignition of the propellant is very high and may reach values of e.g. 4000 bar, so that large loads are imparted on the casing. The casing must be constructed to reliably withstand these loads in order to avoid a malfunction of the firearm and injuries to the user. Further, usually the bottom wall has to be of increased thickness as compared to the remaining portions of the casing in order to withstand the impact force from the striker or firing pin without bursting. In that case, particularly high stresses and a corresponding considerable notch effect typically occur in particular in the transition region between the thick bottom wall and the cylindrical sleeve portion, which is preferably constructed from thinner material for weight considerations, and result in a considerable risk of crack formation.

Further, the casing must be constructed such that upon release of the pressure the casing is able to return somewhat towards its original shape in order to allow the extraction of the empty casing from the firing chamber by a suitable extraction mechanism. Such extraction mechanisms typically engage an extractor groove or an annular projection or step provided on the outer surface of the casing.

Conventional cartridge cases for firearms are unitary in construction. Since more than 100 years they are usually manufactured in one piece from brass and to a smaller extent from steel or aluminum by a plurality of successive steps involving drawing and in particular deep drawing and utilizing a plurality of machines. In this regard, annealing steps have to be carried out between the individual forming steps, such as e.g. drawing, stamping, turning, trimming, drilling, polishing, machining and/or heading steps, for recrystallizing the casing material, and the annealing steps require washing, etching and/or deoxidizing steps prior to the next forming step. The large number of steps substantially adds to the total costs of cartridges.

Brass is the most commonly utilized material because it has the advantageous properties of being relatively ductile and soft, thereby readily allowing deep drawing with a high forming degree without causing excessive wear and strain to the forming dies. Further, it is also sufficiently elastic for ensuring that the empty casing can be removed from the firing chamber. However, brass is comparably heavy and, due to its high copper content, expensive.

Steel has been used to a lesser degree. Due to its inferior deformability and ductility as compared to brass, by the above conventional manufacturing process involving deep drawing steel cartridge cases can only be produced with substantially higher engineering effort and additional annealing steps.

For particular applications requiring a reduced weight of the cartridge casing aluminum has also been used as casing material. However, it comprises a substantially reduced tensile strength and therefore exhibits a high risk of catastrophically failing in the case of the high pressures typically occurring in firearm cartridge casings. For this reason, aluminum casings are not suitable for use with most firearms.

It is therefore an object of the present invention to provide a firearm cartridge casing which can be produced in a more cost-efficient manner and which broadens the range of materials from which one may choose without affecting the operational properties of the cartridge casing and the corresponding cartridge, and to provide a method for producing such cartridge casing.

This object is achieved by a cartridge casing as claimed in claim 1 and by a method as claimed in claim 11. Advantageous embodiments of the cartridge casing and of the method are the subject-matter of the respective dependent claims.

According to the present invention a cartridge casing for firearm ammunition and in particular rifle and handgun ammunition comprises an elongate interior cavity for receiving a propellant and a projectile, i.e. the bullet. Preferably, the cartridge casing is a casing for small firearm ammunition, i.e. the casing has an outer radial diameter corresponding to a caliber of 0.5 or less, which means that the casing is adapted for use in firearms having barrel diameters of 12.7 mm (0.5 Inch) or less. The elongate casing has two opposite ends in the longitudinal direction, and the interior cavity is open at one of these ends, which will receive the projectile in the assembled state of a corresponding cartridge, and substantially closed at the other end by a bottom wall forming the bottom of the cavity. Thus, the two longitudinal ends are commonly referred to as top end and bottom end, respectively. Consequently, in the present application terms such as "top", "bottom", "upper" and "lower" relate in the usual manner to an orientation of the casing in which its bottom wall is facing downwardly and in which, once a corresponding cartridge has been assembled, the projectile forms the top end or tip of the cartridge. The casing and the interior cavity define a longitudinal axis along which the casing extends between the top end and the bottom end. Preferably the casing is rotationally symmetric and more preferably has a circular cross-section along its entire length.

The interior cavity of the casing is confined or bounded in the radial direction, i.e. perpendicular to the longitudinal axis, by a circumferentially extending sidewall which is a part of or preferably is an elongate tubular portion which defines the longitudinal axis of the casing and has a first axial end forming the top end of the casing and an opposite second axial end. Preferably the tubular portion is cylindrical or has cylindrical symmetry about the longitudinal axis or comprises a plurality of longitudinal sections each of which is cylindrical or has cylindrical symmetry.

Further, at the bottom the interior cavity of the casing is confined or bounded by the bottom wall which is connected to the second axial end of the tubular portion, i.e. the tubular portion extends in the longitudinal direction from the bottom wall. The bottom wall comprises a bore extending between the bottom surface and the top surface of the bottom wall, and this bore is arranged for receiving the ignition means of the cartridge, such as e.g. a primer for igniting the propellant within the interior cavity upon impact by a firing pin or striker of the firearm into which the assembled cartridge is loaded.

On a lateral outer surface of the casing an annular projection located proximate the bottom end of the casing is provided. The annular projection extends circumferentially in a plane perpendicular or essentially perpendicular to the longitudinal axis of the casing. The annular projection can be engaged by an extraction mechanism of the respective firearm in order to effect extraction of the empty casing from the firing chamber after firing. The annular projection and more particularly a step defined by the annular projection may serve to define one axial boundary of an extractor groove which extends circumferentially in a plane perpendicular or essentially perpendicular to the longitudinal axis of the casing. The other axial boundary is defined by a further step or projection, such that such an extractor groove extends between two axially spaced projections or steps.

The casing comprises two physically distinct components, i.e. separately manufactured components or elements, which are fixedly secured to each other e.g. by mechanical means, namely an elongate tubular sleeve component, which is open at both axial ends, and a bottom component. The casing may consist of only these two components, but may also comprise one or more additional physically distinct components, in particular one or more fixing components used for fixedly securing the sleeve component and the bottom component to each other, such as, e.g. one or more rivets or rivet-like elements. The tubular portion of the casing is a part of or constituted by the sleeve component. Thus, the sleeve component defines the entire radial or lateral boundary of the interior cavity, i.e. the entire sidewall of the interior cavity. The bottom wall of the casing is formed at least in part and preferably to a major part or entirely by the bottom component. In this regard it is to be noted that a part and preferably only a minor part of the bottom wall may also be formed by a corresponding portion of the sleeve component.

In the longitudinal direction of the casing the bottom component comprises a lower end surface and an opposite upper end surface, i.e. end surfaces facing away from the cavity and towards the cavity, respectively. A circumferential lateral outer surface, which may e.g. be cylindrical, extends between and connects the two end surfaces, and the annular projection is provided on the lateral or radial outer surface. Further, in case of an extractor groove defined or bounded in part by the annular projection, the extractor groove is provided or extends completely or in part in the lateral or radial outer surface. As will be explained below, this could be realized such that one of the two axial borders or sidewalls of the extractor groove, i.e. the step or projection opposite the annular projection, is formed by an adjacent axial end portion of the sleeve component.

This construction of a cartridge casing provides the advantage that due to the possibility to separately produce the sleeve component and the bottom component the number of steps necessary for manufacturing the casing is substantially decreased. For example, it is possible to produce the sleeve component by deep drawing without intermediate annealing and in particular in a single step by means of a transfer press or entirely inside a transfer process without removing it from the process in an intermediate step, and the bottom portion may e.g. be produced by machining a plate-shaped element or by a simple forming process utilizing a suitable die, such as a forming or press die. Moreover, this possibility also enables use of materials different from brass, which are not suitable for conventional manufacturing processes, without creating additional problems. In this regard, it is also possible to select different materials for the sleeve component and the bottom component. Further, manufacturing is also considerably simplified by the fact that the annular projection for engagement by an extraction mechanism or the extractor groove is formed on the bottom component. In particular, if the bottom component is produced by a forming process, the annular projection or extractor groove can be formed readily by means of that same forming process, so that the material removal techniques typically utilized today do not have to be employed. Moreover, it is possible to construct the cartridge casing to withstand higher interior gas pressures without crack formation or rupturing.

In a preferred embodiment each of the sleeve component and the bottom component are integrally formed in one piece. This further simplifies manufacturing of the casing.

It is advantageous if the bottom component is a planar and preferably circular plate-shaped element or a planar and preferably circular ring extending perpendicularly to the longitudinal axis of the casing. Such a bottom component is particularly simple to manufacture.

In a preferred embodiment a wall thickness of the bottom component and in particular a wall thickness in the longitudinal direction is greater than the wall thickness of the sleeve component, which may or may not be constant throughout the entire length of the sleeve component. Thus, the maximum thickness of the bottom component, in particular the maximum thickness in the longitudinal direction of the casing, is greater than the maximum wall thickness of the sleeve component. In other words, the material of the bottom component constituting the bottom wall is thicker than the material constituting the sleeve component anywhere in the sleeve component. Such a bottom component can advantageously be constructed such that it is both suitable for receiving an ignition means and serves to achieve the outer cartridge case dimensions to which existing firearms are adapted.

However, in an alternative preferred embodiment the maximum wall thickness of the bottom component and in particular the maximum wall thickness in the longitudinal direction may also be identical or essentially identical or smaller than the maximum wall thickness of the sleeve component without increasing the notch effect and sacrificing resistance against crack formation or rupturing. By way of such an arrangement the weight and material consumption of the cartridge casing can be significantly decreased as compared to corresponding conventional cartridge casings.

In a preferred embodiment the bottom component and the sleeve component are fixedly secured to each other by means of adhesive bonding, riveting, clinching, clamping, laser welding or combinations thereof. In this regard, it is also possible that a separate and physically distinct connection component is utilized for fixedly securing the bottom component and the sleeve component to each other. Such a connection component may e.g. having an annular shape and clamp the bottom component and the sleeve component to each other. For example, such a connection component may be a rivet or rivet-shaped. In the case of adhesive bonding it is advantageous to arrange the adhesive such that it also serves for sealing the interior cavity against ingress of liquids and moisture.

In an advantageous arrangement the sleeve component is fixedly secured at one of its two axial terminal ends to the upper end surface of the bottom component. Manufacture is thereby further simplified. This is even more the case if at the axial end of the sleeve component at which it is fixedly secured to the bottom component the sleeve component comprises or terminates in a radially inwardly projecting flange or rim having an annular end face facing and abutting the upper end surface of the bottom component. Such a radially inwardly projecting flange may advantageously be constituted by a corresponding end portion of the tubular sleeve component being bent radially inwardly over its entire circumference towards the longitudinal axis, preferably by 90° or substantially 90°. It may be produced directly in a transfer press, e.g. utilizing a deep drawing process. Preferably a cup-shaped component is produced in the transfer press from a blank, in particular a round blank, and a bore is provided in the bottom of the cup-shaped component inside the transfer press or after taking the component out of the transfer press and before mounting the sleeve component to the bottom component. It has been proven that the notch effect and the risk of crack formation in the transition region between the bottom wall and the tubular portion, in particular in case the bottom wall is thicker than the tubular portion, are substantially reduced due to the more homogenous wall thickness distribution in the transition region between the flange portion and the sidewall portion of the sleeve component. In this regard, obturation of the casing without crack formation in this transition region is significantly promoted by the flow of material from the bottom wall and of the bottom component.

In these advantageous arrangements it is further preferred that in the direction of the longitudinal axis of the casing the bottom component comprises a first section and an adjacent second section, both of which are preferably cylindrical or substantially cylindrical, wherein the radial diameter of the second section is smaller than the radial diameter of the first section. The first section extends from the lower axial end surface of the bottom component up to the beginning of the second section, and the second section extends in towards and preferably up to the upper axial end surface of the bottom component. Thus, the first and second sections meet at an annular and circumferentially extending step, which is preferably a right-angled or 90° step. In this manner, the first section constitutes the annular projection, which is provided in the form of a circumferentially extending flange or rim radially projecting outwardly as compared to the second section, and accordingly the second section constitutes a recessed portion of the bottom component. Further, the bottom component may also comprise a third section adjacent to the second section and having a radial diameter that is greater than the radial diameter of the second section and may be identical or essentially identical to the radial diameter of the first section or annular projection. However, for reasons of ease of manufacture it is preferred that the second section of the bottom component extends up to the upper axial end surface of the bottom component and that the portion of the sleeve component immediately adjacent to and extending from the bottom wall has a radial diameter that is greater than the radial diameter of the second section of the bottom component, and e.g. identical or essentially identical to the radial diameter of the first section or annular projection, so that another annular and circumferentially extending step, which is again preferably a right-angled or 90° step, is present between the second section of the bottom component and the sleeve component. Due to this arrangement an extractor groove of the above-mentioned type is defined by the region between the two projecting steps formed preferably by the annular projection or flange and by the above-described portion of the sleeve component, respectively. Thus, the upper boundary of the extractor groove is preferably formed by a portion of the sleeve component. By means of these arrangements and in particular by means of the arrangement in which the second section of the bottom component extends to the upper axial end surface of the bottom component, the formation of an extractor groove is greatly simplified.

Because of the particular two part construction of the casing it is advantageously possible for forming the bottom component to select from a wide range of uncoated or coated rustless or stainless materials or materials subject to corrosion but protected by a suitable coating. In accordance with a preferred embodiment the bottom component comprises steel, aluminum or another metal or a metal alloy or is made of or consists of one of these materials. For example, due to the above-described construction of the casing steel or aluminum can be chosen for reducing weight and costs without sacrificing the operational characteristic and in particular the mechanical stability of the casing. Further, it is also possible to use a bottom component in the annular projection or the extractor groove is produced by a turning process.

In preferred embodiments the sleeve component comprises, is made of or consists of steel, aluminum, a metal different than aluminum, a metal alloy or a plastic material. By such choice weight and costs can be further reduced. Of course, the sleeve component may also comprise, be made of or consist of brass.

As already noted above, the bottom component may comprise a material subject to corrosion. The same also applies to the sleeve component. In any case, it may be advantageous that the bottom component and/or the sleeve component are coated with a corrosion-inhibiting or corrosion-resistant material or provided with a suitable coating for obtaining other desired properties of the casing. The possibility of a coating, which is particularly easy to realize in case of a mechanical connection between bottom and sleeve components, advantageously broadens the range of materials from which one can choose for producing the two components. Possible coatings are or comprise as a basis epoxide resins, phenolic resins, acrylics, fluoropolymers, such as PTFE, PFA, FEP, PVDF or fluorided polymers, fluoropolymers with the aforementioned polymers as copolymer, polyurethane, silane or siloxane, antifriction coatings and/or metal-clad or metal-plated surfaces comprising one or more layers. For example, a strip of material which is plated with nickel may advantageously be used to form the sleeve component and/or the bottom component.

According to the present invention a cartridge casing for firearm ammunition may very simply and advantageously be manufactured by a method in which at first a bottom component and a sleeve component having any of the constructive arrangements outlined above are formed or provided, and subsequently the separate sleeve component and bottom component are fixedly secured or attached to each other by suitable means. It has already been explained in detail that such a manufacturing method for a cartridge casing provides significant cost advantages and enables use of a wide range of materials and dimensions without affecting the operational characteristics of the casing. The two components may e.g. be produced by machining, casting, molding, stamping or pressing or combinations thereof.

In such a manufacturing method the sleeve component may advantageously be formed or produced, e.g. in a single manufacturing step, by means of a transfer press. In particular, the sleeve component may be entirely formed—possibly except for providing a bore through the bottom of a cup-shaped perform—entirely inside the press without having to take it out for intermediate processing. All substeps are carried out inside the press. In any case, the sleeve component, which may be produced e.g. by deep drawing, does not have to be subjected to annealing steps, so that the manufacture can be carried out without intermediate annealing. Further, the bottom component may advantageously be formed or produced by means of a forming and/or machining process using a suitable die or tool. Also the bottom component can advantageously be produced in one step or without removing it from the die or tool and without intermediate annealing steps. Strip or wire shaped materials may advantageously be used as base materials. For example, the sleeve component and/or the bottom component may be produced by cutting a blank or round blank from a coil of strip or wire shaped material, then introducing the blank into a press, such as a deep drawing press, and completely forming the respective sleeve component or bottom component in the press without taking it out for intermediate processing steps.

In a preferred embodiment providing the bottom component and/or providing the sleeve component comprises a coating step which is carried out prior to fixedly securing the sleeve component to the bottom component. Possible advantageous coatings have already been indicated above, and the coating step of the bottom component or the sleeve component may comprise any of dip coating, spray coating, powder coating, electrostatic powder coating, micropowder coating, scaling, oxidation, solid grease coating, cold plasma coating and/or vacuum plasma coating.

Preferably, the sleeve component and the bottom component are constructed such that they are self-centering upon fixedly securing or attaching them to each other, i.e. such that upon securing or attaching them to each other the bottom component are automatically arranged with respect to the sleeve component in relative coaxial relationship.

In the following, the invention is explained in more detail for preferred embodiments with reference to the figures.

In the various Figures, identical or similar elements are designated by identical reference numerals.

Figure 1:
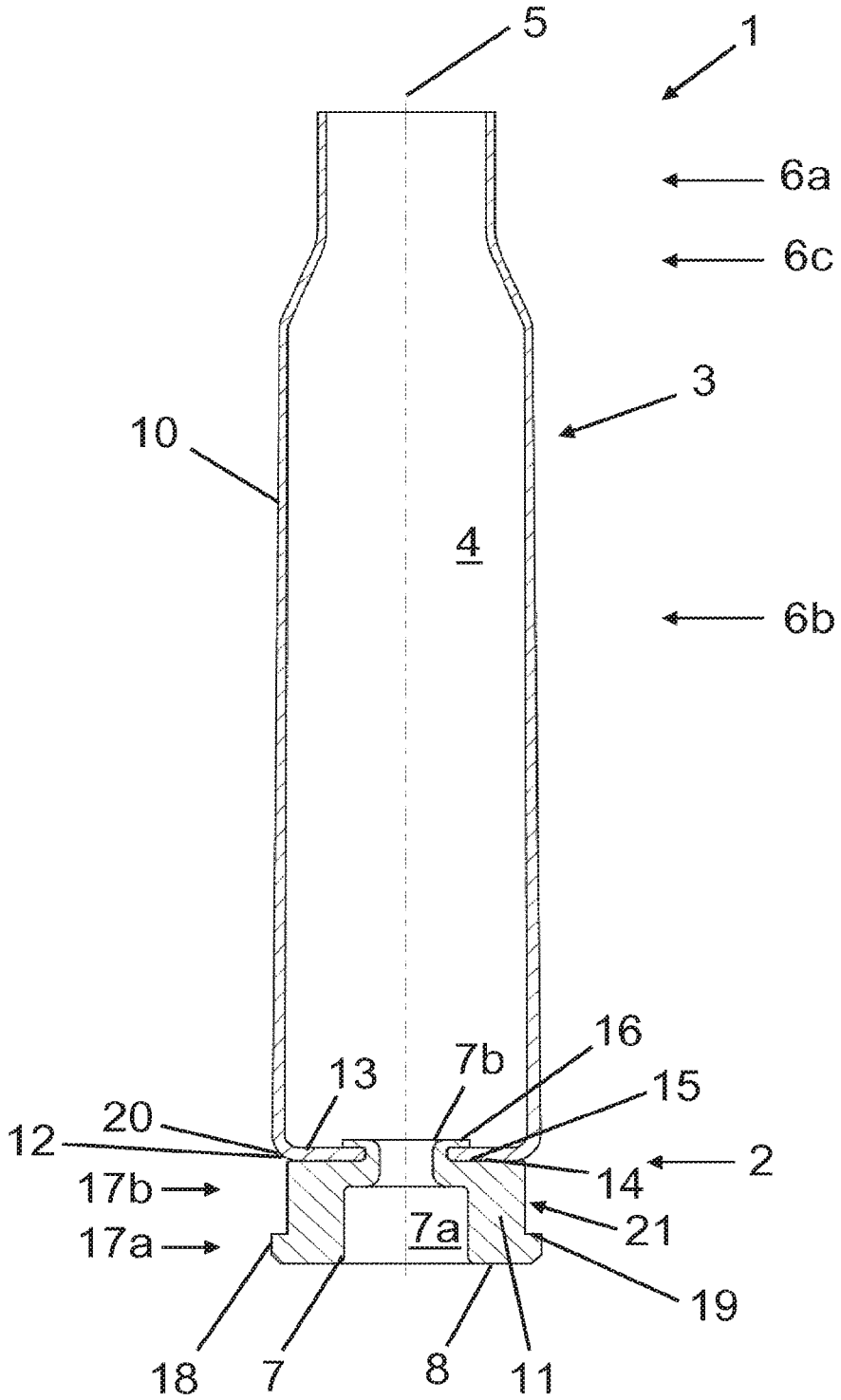
FIG. 1 shows a schematic cross sectional view of an embodiment of a cartridge casing for firearm ammunition.

In Figures a cartridge casing 1 is shown in cross section which is to be used in a cartridge for firearm ammunition and preferably for ammunition for rifles and handguns. The casing 1 is elongate and is constituted by a plate shaped bottom wall 2 and a sidewall 3 extending upwardly generally perpendicularly from the bottom wall 2. Thus, the casing 1 is hollow and encloses and defines an elongate interior cavity 4. The bottom wall 2 preferably has a circular shape, and, accordingly, the sidewall 3 preferably has cylindrical symmetry about the longitudinal axis 5 of the casing 1 and the cavity 4.

The sidewall 3, which is an elongate tubular portion, comprises in the longitudinal direction two sections 6*a* and 6*b* having different diameters and a corresponding transition region 6*c* between the lower, larger diameter section 6*b* and the upper, smaller diameter section 6*a*. The individual section 6*a* and 6*b* may or may not slightly taper in the longitudinal direction, in particular in the direction away from the bottom wall 2.

The bottom wall 2 comprises a through bore 7 which extends in the longitudinal direction and has a lower, large diameter section 7*a* extending from the lower axial end surface 8 of the bottom wall 2 and an upper, small diameter section 7*b*.

When assembling a cartridge, an ignition means for cooperating with e.g. a firing pin or striker of a firearm is disposed within the through bore 7, a bullet is arranged in the small diameter section 6*a* of the sidewall 3 and e.g. frictionally retained therein, and a propellant is disposed inside the cavity 4 such that it is located between the bullet and the ignition means.

As can be taken from Figures, the casing 1 is composed of (in the case of the embodiments shown in FIGS. 1, 3 and 4) or comprises (in the case of the embodiment shown in FIG. 2) two separate elements or components, namely an elongate tubular sleeve component 10 and a bottom component 11, which are mechanically secured to each other. In this regard it should be noted that, as will be explained in the following, in the embodiments shown in the Figures the sleeve component 10 is not identical with the elongate tubular portion forming the sidewall 3, but that the sleeve component 10 also forms a relatively small portion of the bottom wall 2. Consequently, while the bottom component 11 forms nearly all of the bottom wall 2, it does not form the entire bottom wall 2.

From the Figures it is also apparent that in the illustrated embodiments the material from which the sleeve component 10 is constructed is of a considerably lower thickness than the material from which the bottom component 11 is constructed. Thus, the thickness of the sleeve component 10 throughout its entire extension is smaller than the thickness of essentially the entire bottom component 11, with the exception of the portion 16 which will be described later-on.

In particular, the thickness contribution provided by the bottom component 11 to the total thickness of the bottom wall 2 in the longitudinal direction is considerably larger than the material thickness anywhere in the sleeve component 10. This thickness is mainly chosen in order to provide for sufficient space to receive a ignition means and for providing conventional outer cartridge casing dimensions expected by existing firearms. However, as already noted above, the bottom component 11 could advantageously also be constructed from a much thinner material without increasing the tendency of the notch effect.

For allowing a simple mechanical attachment of the bottom component 11 to the sleeve component 10 the sleeve component 10 is formed such that at its lower end 12 it comprises a radially inwardly projecting and annular flange 13, the lower surface 14 of which constitutes an annular lower axial end surface or bottom surface of the sleeve component 10. In the embodiment illustrated in FIGS. 1, 2 and 4, the surface 14 is the lowermost portion of the sleeve component 10, i.e. the lower terminal axial end thereof. This bottom surface 14 of the sleeve component 10 is arranged in abutment with a corresponding annular upper axial end surface 15 of the bottom component 11 and may be attached thereto by suitable means.

Figure 4:
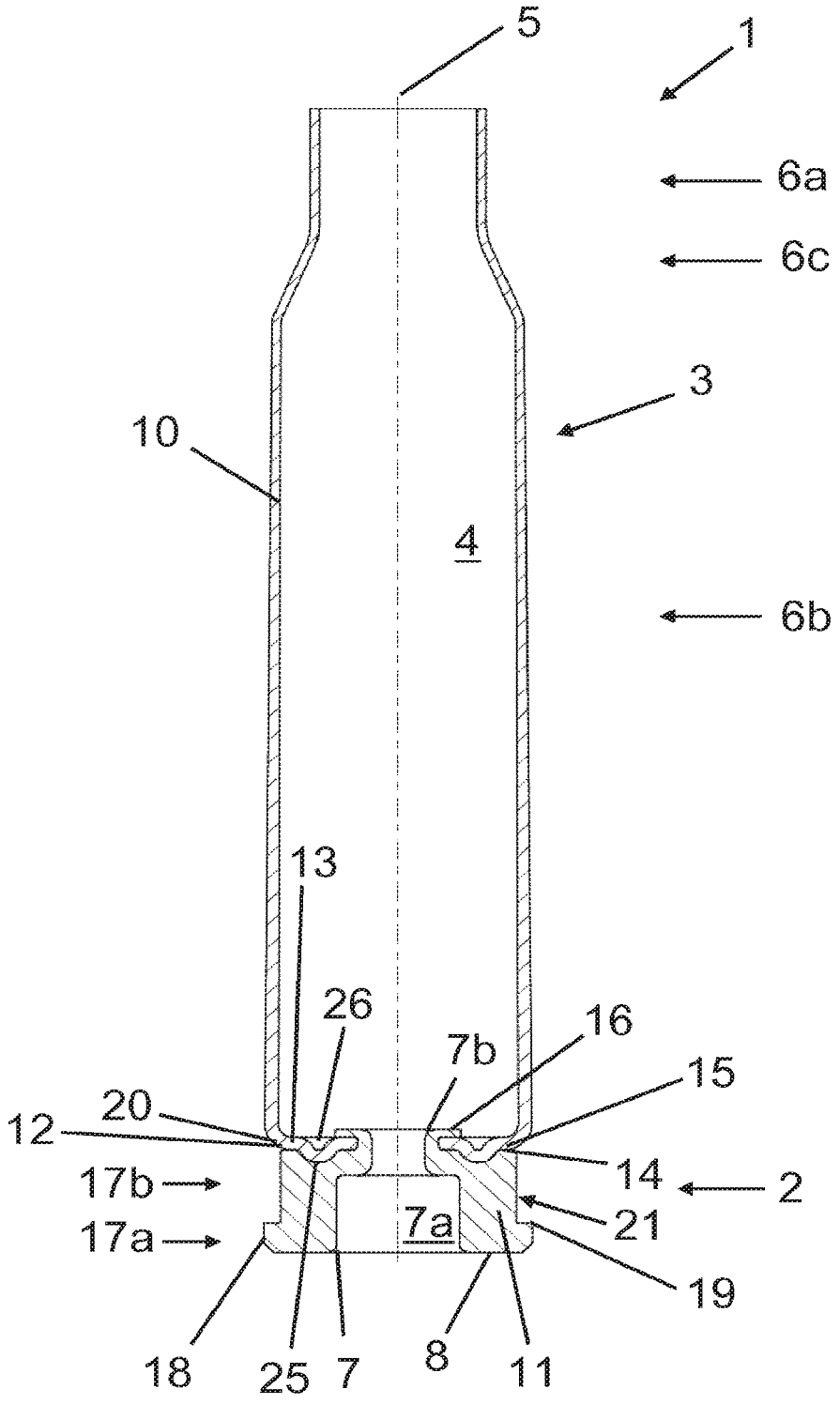
FIG. 4 shows a schematic cross sectional view of another embodiment of a cartridge casing for firearm ammunition.

In the embodiments illustrated in FIGS. 1 and 4, the attachment is effected by an annular bent-back portion 16 of the bottom component 11, which portion 16 extends in parallel to and at a certain axial distance from the annular upper axial end surface 15 of the bottom component 11 in the immediate vicinity of the through bore 7. The annular flange 13 of the sleeve component 10 is arranged to extend into the annular space defined by the end surface 15 and the bent-back portion 16 of the bottom component 11, and the sleeve component 10 is thereby locked in place and securely retained on the bottom component 11 in the position illustrated in these Figures. Due to the mating construction of the annular bent-back portion 16 of the bottom component 11 and of the annular flange 13 of the sleeve component 10, the sleeve component 10 and the bottom component 11 are advantageously self-centering upon assembly.

Figure 3:
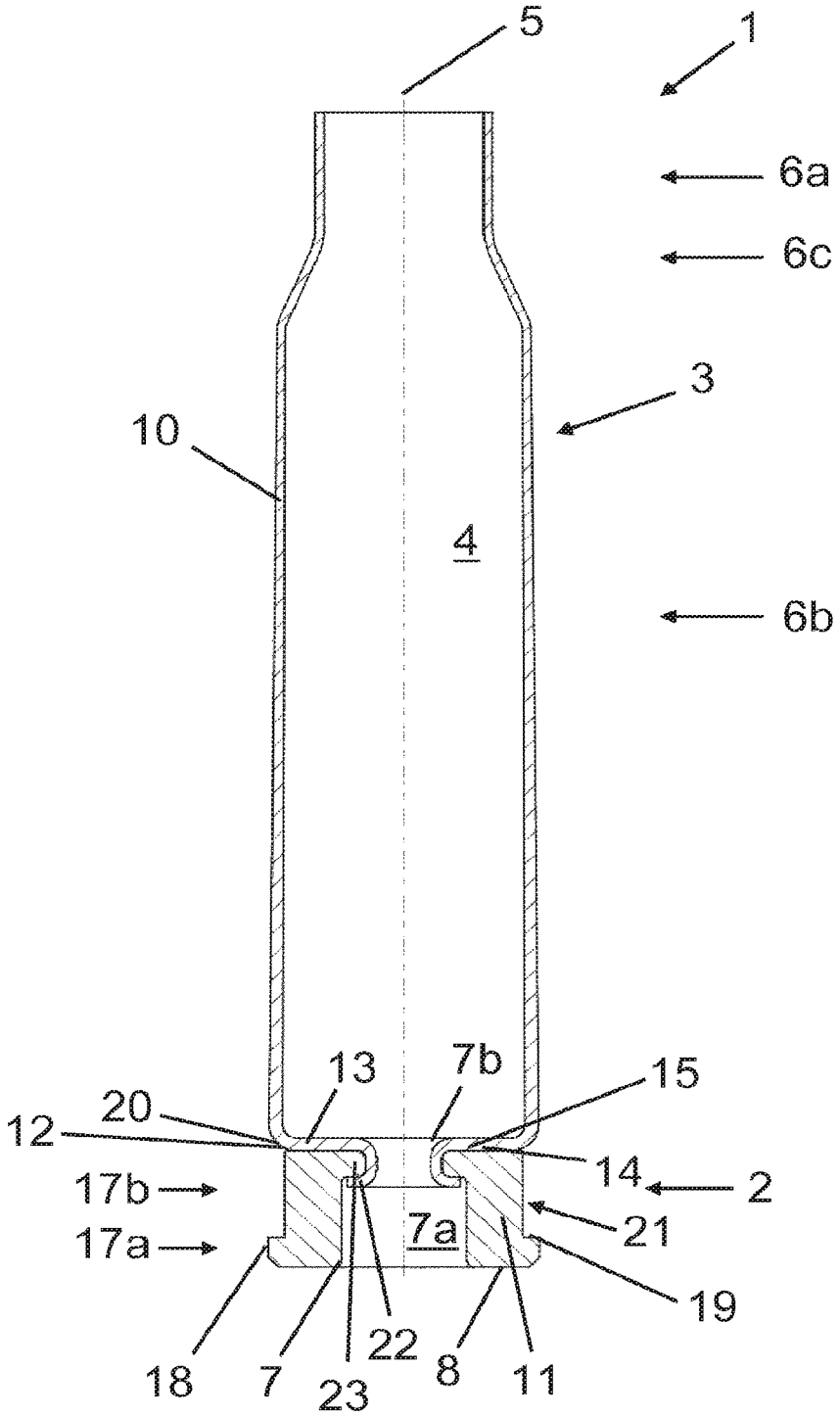
FIG. 3 shows a schematic cross sectional view of another embodiment of a cartridge casing for firearm ammunition.

By contrast, in the embodiment illustrated in FIG. 3 the attachment is effected by an annular bent-back portion 22 of the sleeve component 10, which portion 22 extends in parallel to and at a certain axial distance from the lower surface 14 of the flange 13 in the immediate vicinity of the through bore 7. The bottom component 11 comprises at its upper end an annular projection 23 which extends into the bore 7 towards the longitudinal axis 5. The projection 23 is arranged to extend into the annular space defined by the lower surface 14 of the flange 13 and the bent-back portion 22 of the sleeve component 10, and the bottom component 11 is thereby locked in place and securely retained on the sleeve component 10 in the position illustrated in FIG. 3. Similar to FIGS. 1 and 4, due to the mating construction of the annular bent-back portion 22 of the sleeve component 10 and of the projection 23 of the bottom component 11, the sleeve component 10 and the bottom component 11 are advantageously self-centering upon assembly.

Figure 2:
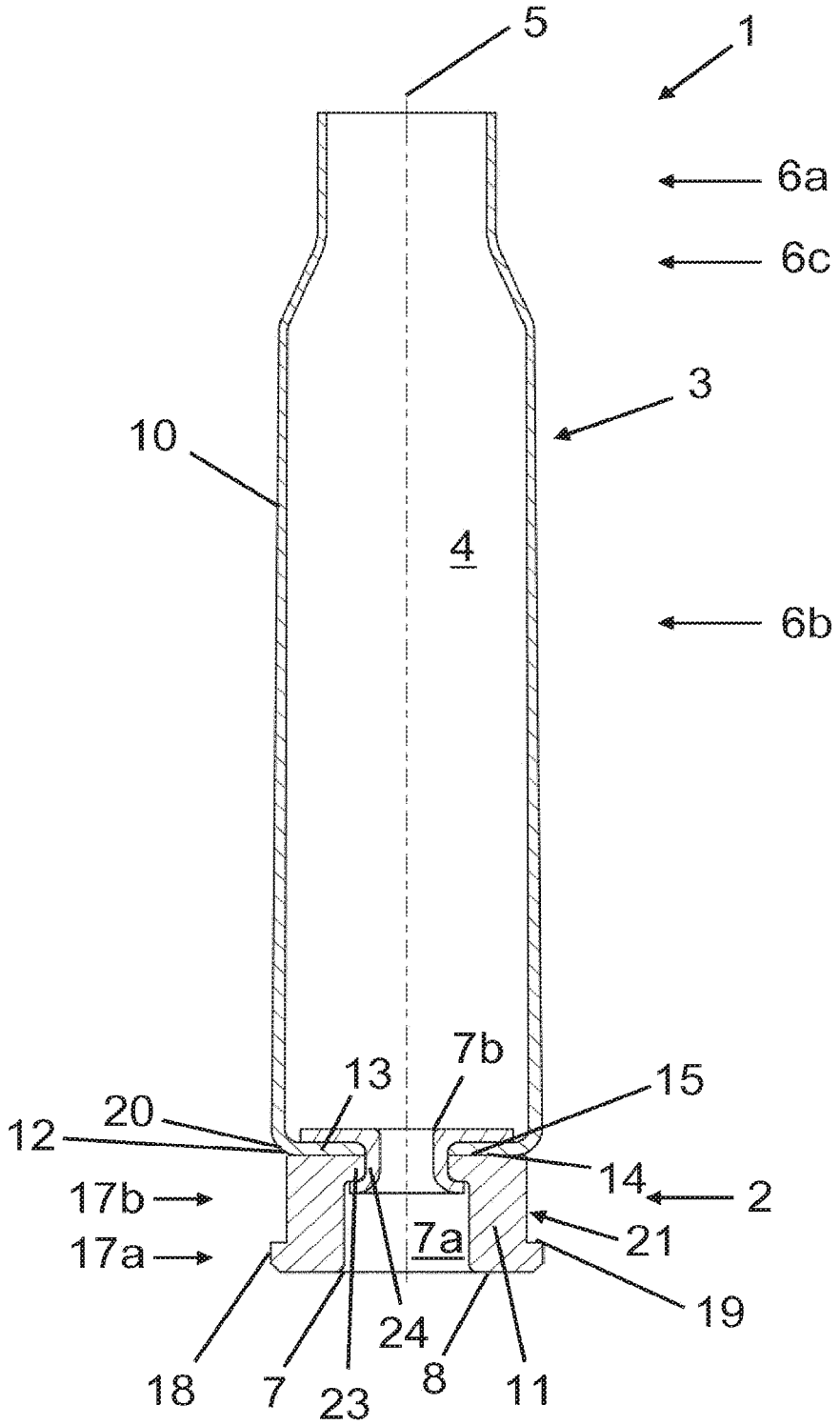
FIG. 2 shows a schematic cross sectional view of another embodiment of a cartridge casing for firearm ammunition.

A further possibility of effecting the attachment is shown in FIG. 2. In the embodiment illustrated a separate and physically distinct connection component 24 is utilized for this purpose. The connection component 24, which acts like and can be regarded as a rivet, is annular and, in a plane extending parallel to the longitudinal axis, has essentially a J-shaped cross sectional shape. As in the case of FIG. 3, the bottom component 11 comprises at its upper end an annular projection 23 which extends into the bore 7 towards the longitudinal axis 5. Both this projection 23 and the flange 13 extend into the annular space defined by the J-shaped cross section of the connection component 24 such that the connection component 24 abuts and presses against the upper surface of the flange 13 and the lower surface of the projection 23. The sleeve component 10 and the bottom component 11 are thereby locked in place and securely retained in the position illustrated in FIG. 2. Similar to above, due to the mating construction of the connection component 24, the flange 13 of the sleeve component 10 and the projection 23 of the bottom component 11, the sleeve component 10 and the bottom component 11 are advantageously self-centering upon assembly.

The resistance to rupturing or to the notch effect may be further increased by providing an annular groove 25 in the annular upper axial end surface 15 of the bottom component 11 engaged by a corresponding annular bulge 26 provided in the flange 13. In this manner additional material is present in the region of the bulge 26 for flowing during the expansion of the cartridge casing upon firing. Of course, it is also possible to provide the groove in the flange 13 and the interengaging bulge in the surface 15 of the bottom component 11.

In any case, it may be advantageous to provide for additional attachment means. In particular, it is possible to provide an adhesive in the contact region between the sleeve component 10 and the bottom component 11. Such an adhesive provides the additional advantage that ingress of liquids and moisture through the interface between the two separate components 10, 11 can be safely prevented.

As can be seen in the Figures, the bottom component 11 has the shape of a planar ring. In the longitudinal direction it comprises two adjacent sections 17*a*, 17*b* having different diameters and forming a sharp rectangular step 19 between them. Thus, the bottom component 11 comprises a lowermost annular projection 18 radially outwardly projecting as compared to the recessed portion 17*b* and actually the entire remainder of the bottom component 11. The or a lower end 12 of the sleeve component 10 and, consequently, the peripheral outer edge 20 of the annular flange 13 of the sleeve component 10 has a diameter which is larger than the diameter of the recessed portion 17*b* of the bottom component 11 and preferably is identical or substantially identical to the diameter of the annular projection 18 of the bottom component 11. Due to this construction an annular groove 21 is present in the radial outer surface of the bottom component 11, wherein the borders or sidewalls of this groove 21 are formed by the two steps 19 and 20. In the assembled cartridge the groove 21 serves as the extractor groove for extracting the empty casing 1 from the firing chamber of the firearm following actuation thereof. In the illustrated manner the extractor groove 21 is particularly simple to manufacture, e.g. in a deep drawing or other press. However, the two section 17*a*, 17*b* may also be produced by machining, e.g. by turning.

Further, it is also possible for the section 17*b* to have the same or essentially the same radial diameter than the or a lower end 12 of the sleeve component 10 and, consequently, the peripheral outer edge 20 of the annular flange 13 of the sleeve component 10. In such a case, the cartridge casing 1 does not comprise an extractor groove, but the annular projection 18 at the very bottom of the bottom component 11 and the step between the projection 18 and the recessed portion 17*b* is provided for engagement by an extraction mechanism.

The invention claimed is:

1. A cartridge casing for firearm ammunition, which casing comprises an elongate interior cavity for receiving a propellant and a projectile and extends along a longitudinal axis between a top end and a bottom end, wherein the cavity is open at the top end of the casing and is confined radially by a circumferentially extending sidewall formed by an elongate tubular portion defining the longitudinal axis of the casing and having a first axial end forming the top end of the casing and an opposite second axial end, and at the bottom by a bottom wall having a bottom surface and a top surface, which bottom wall is connected to the second axial end of the tubular portion and comprises a bore extending between the bottom surface and the top surface of the bottom wall and being arranged for receiving an ignition means, wherein the casing further comprises in a lateral outer surface an annular projection located proximate the bottom end of the casing and extending circumferentially in a plane perpendicular to the longitudinal axis (5) of the casing, characterized in that the casing comprises an elongate tubular sleeve component open at both axial ends and a separate bottom component fixedly secured to the sleeve component, wherein the tubular portion of the casing is formed by the sleeve component, so that the sidewall is constituted in its entirety by the sleeve component, wherein, along the entire length of the interior cavity from the top end to the bottom end thereof, in cross-section perpendicular to the longitudinal axis a circumferential outermost surface of the casing is a surface of the sidewall, the bottom wall of the casing is formed at least in part by the sleeve component and at least in part by the bottom component, and the bottom component comprises a lower axial end surface, an opposite upper axial end surface and a circumferentially extending lateral outer surface on which the annular projection is arranged and is constructed for receiving an ignition means, wherein the bottom component further comprises at an upper end a second annular projection which extends into the bore towards the longitudinal axis, and the sleeve component is fixedly secured at one of its two axial ends to the upper axial end surface of the bottom component, wherein at the axial end of the sleeve component at which the sleeve component is fixedly secured to the bottom component the sleeve component comprises a radially inwardly projecting flange having an annular end face facing and abutting the upper end surface of the bottom component, and wherein the casing further comprises an annular connection component having essentially a J-shaped cross sectional shape, wherein the second projection and the flange extend into an annular space defined by the J-shaped cross section of the connection component such that the connection component abuts and presses against an upper surface of the flange and a lower surface of the projection.

2. The cartridge casing according to claim 1, wherein the sleeve component and the bottom component are self-centering upon assembly.

3. The cartridge casing according to claim 1, wherein the bottom component is a plate-shaped element or a planar ring extending perpendicularly to the longitudinal axis of the casing.

4. The cartridge casing according to claim 1, wherein a wall thickness of the bottom component is greater than the wall thickness of the sleeve component.

5. The cartridge casing according to claim 1, wherein the bottom component and the sleeve component are fixedly secured to each other by means of adhesive bonding, riveting, clinching, laser welding or combinations thereof.

6. The cartridge casing according to claim 1, wherein the bottom component comprises in the direction of the longitudinal axis of the casing a first section extending from the lower axial end surface of the bottom component and an adjacent second section extending from the upper axial end surface of the bottom component and having a radial diameter smaller than the radial diameter of the first section, such that the first section constitutes the annular projection and the second section constitutes a recessed portion of the bottom component, wherein the portion of the sleeve component immediately adjacent to and extending from the bottom wall has a radial diameter that is greater than the radial diameter of the second section of the bottom component, such that an extractor groove is defined by the region between the two projecting steps formed by the annular projection and by the portion of the sleeve component, respectively.

7. The cartridge casing according to claim 1, wherein the bottom component is made of steel, aluminum or another metal or a metal alloy and/or wherein the sleeve component is made of steel, aluminum, another metal, a metal alloy or a plastic material.

8. The cartridge casing according to claim 1, wherein the bottom component and/or the sleeve component are coated with a corrosion-inhibiting material.

9. A method of manufacturing a cartridge casing according to claim 1, comprising providing the bottom component and the sleeve component and fixedly securing the sleeve component to the bottom component.

10. The method according to claim 9, wherein providing the bottom component and the sleeve component comprises producing the sleeve component by means of a transfer press and/or producing the bottom component by means of a forming and/or machining process.

11. The method according to claim 10, wherein producing the sleeve component and/or producing the bottom component does not comprise intermediate annealing steps.

12. The method according to claim 9, wherein providing the bottom component and/or providing the sleeve component comprises a coating step which is carried out prior to fixedly securing the sleeve component to the bottom component.

13. The method according to claim 9, wherein the coating step comprises dip coating, spray coating, powder coating, electrostatic powder coating, micropowder coating, scaling, oxidation, solid grease coating, cold plasma coating and/or vacuum plasma coating.

14. The method according to claim 9 wherein providing the bottom component and/or providing the sleeve component comprises a coating step which is carried out prior to fixedly securing the sleeve component to the bottom component.

15. The method according to claim 14, wherein the coating step comprises dip coating, spray coating, powder coating, electrostatic powder coating, micropowder coating, scaling, oxidation, solid grease coating, cold plasma coating and/or vacuum plasma coating.

* * * * *